US005695148A

United States Patent [19]

Christensen

[11] Patent Number: 5,695,148

[45] Date of Patent: Dec. 9, 1997

[54] LIGHT STRING STORAGE REEL

[76] Inventor: Karl Russell Christensen, 1626 Davis St., Corona, Calif. 91720

[21] Appl. No.: 695,112

[22] Filed: Aug. 8, 1996

[51] Int. Cl.[6] ..... B65H 75/14

[52] U.S. Cl. ..... 242/405.3; 242/580; 242/613

[58] Field of Search ..... 242/118.4, 118.41, 242/134, 405, 405.1, 405.2, 405.3, 579, 580, 588.1, 588.2, 594.3, 605, 613, 614

[56] References Cited

U.S. PATENT DOCUMENTS

| | | | |
|---|---|---|---|
| D. 314,910 | 2/1991 | VanSkiver | D8/359 |
| D. 334,334 | 3/1993 | Jarry | D8/359 |
| D. 334,882 | 4/1993 | Bunch | D8/359 |
| 1,802,104 | 4/1931 | Bilger et al. | 242/580 |
| 2,467,607 | 4/1949 | Bates | 242/613 |
| 3,437,281 | 4/1969 | Quenot | 242/405 |
| 4,022,398 | 5/1977 | Youngblood | 242/580 |
| 4,200,249 | 4/1980 | Synstelien | 242/407 |
| 4,442,984 | 4/1984 | Bayat | 191/12.4 |
| 4,520,239 | 5/1985 | Schwartz | 191/12.4 |
| 4,557,430 | 12/1985 | Bonhard | 191/12.2 R |
| 4,721,833 | 1/1988 | Dubay | 191/12.4 |
| 4,901,939 | 2/1990 | Obst et al. | 242/118.4 |
| 4,984,685 | 1/1991 | Douglas | 242/580 |
| 5,458,241 | 10/1995 | Brown | 242/405.2 |

FOREIGN PATENT DOCUMENTS

| | | | |
|---|---|---|---|
| 571045 | 2/1959 | Canada | 242/118.41 |

*Primary Examiner*—John P. Darling

[57] ABSTRACT

A light string storage reel comprises at least one reel including a center section and first and second side sections, each center section being formed in a generally cylindrical configuration with an essentially hollow interior, each side section having a hole and being affixed to the center section, the first side section including an aperture and a slot, the aperture being in communication with the hollow interior of the center section for storage of the string of lights and accessories, in an operative orientation a user placing a plug of a string of lights through the slot to secure it in place, the user then rotating the reel thereby winding the string of lights.

4 Claims, 3 Drawing Sheets

10

12
30
14
32
24
16
40
18
22
44
42
46

16

44
46
26
32
20
34

FIG 3
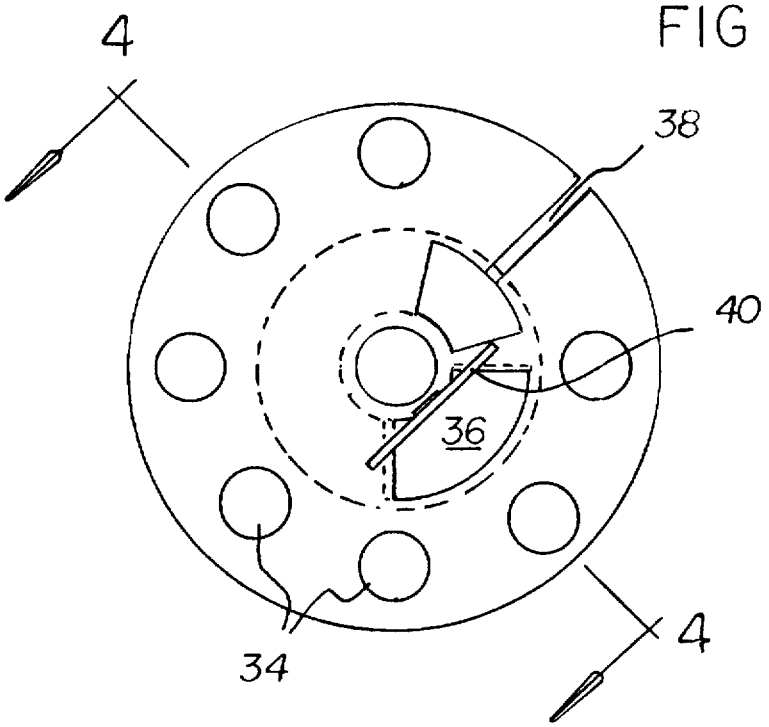
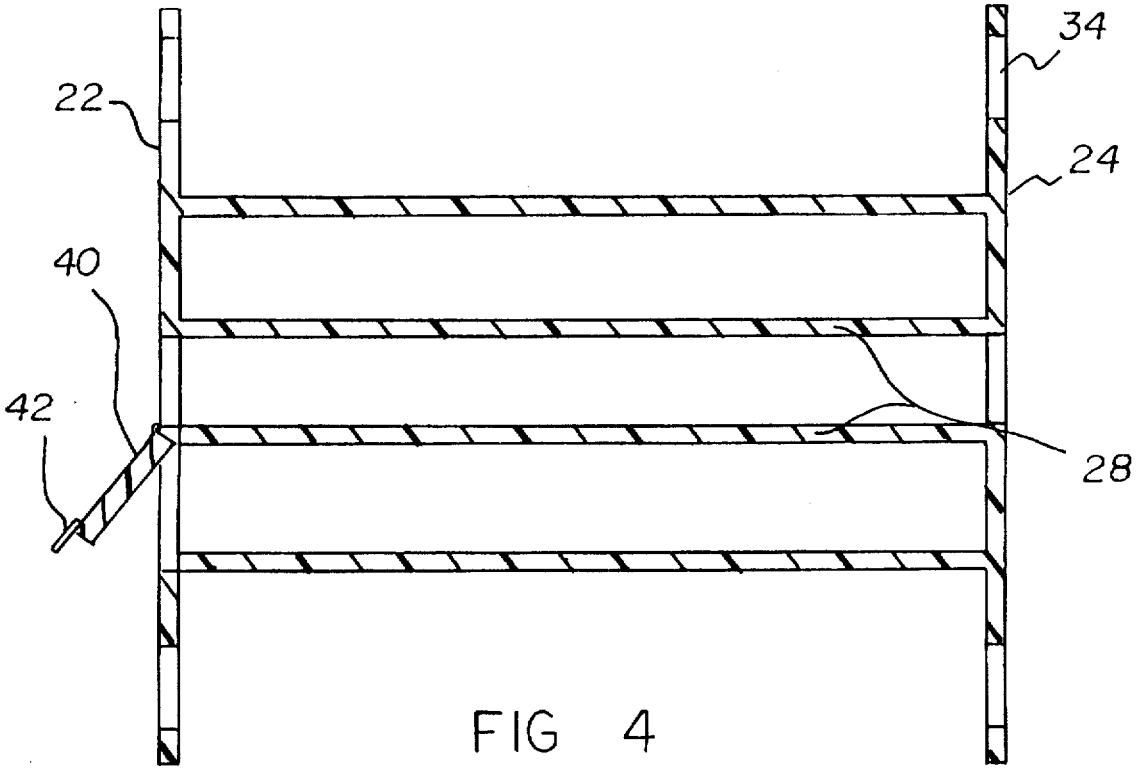
FIG 4

LIGHT STRING STORAGE REEL

BACKGROUND OF THE INVENTION

1. Field of the Invention

The present invention relates to a light string storage reel and more particularly pertains to storing strings of lights and light accessories in a neat and organized fashion.

2. Description of the Prior Art

The use of reels is known in the prior art. More specifically, reels heretofore devised and utilized for the purpose of storing cord and string are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,721,833 to Dubay discloses a retrievable electric cord reel.

U.S. Pat. No. Des. 314,910 to VanSkiver discloses a cord storage reel.

U.S. Pat. No. Des. 334,882 to Bunch discloses a combined electric cord reel and dispenser.

U.S. Pat. No. Des. 334,334 to Jarry discloses an extension cord reel.

U.S. Pat. No. 4,520,239 to Schwartz discloses an electrical cord reel and storage system.

U.S. Pat. No. 4,557,430 to Bonhard discloses a power cord storage and dispenser.

U.S. Pat. No. 4,442,984 to Bayat discloses an electric cord reel.

While these devices fulfill their respective, particular objective and requirements, the aforementioned patents do not describe a light string storage reel for storing strings of lights and light accessories in a neat and organized fashion.

In this respect, the light string storage reel according to the present invention substantially departs from the conventional concepts and designs of the prior art, and in doing so provides an apparatus primarily developed for the purpose of storing strings of lights and light accessories in a neat and organized fashion.

Therefore, it can be appreciated that there exists a continuing need for new and improved light string storage reel which can be used for storing strings of lights and light accessories in a neat and organized fashion. In this regard, the present invention substantially fulfills this need.

SUMMARY OF THE INVENTION

In the view of the foregoing disadvantages inherent in the known types of reels now present in the prior art, the present invention provides an improved light string storage reel. As such, the general purpose of the present invention, which will be described subsequently in greater detail, is to provide a new and improved light string storage reel and method which has all the advantages of the prior art and none of the disadvantages.

To attain this, the present invention essentially comprises a new and improved light string storage reel comprising, in combination: a string of lights having a male outlet plug and a plurality of light bulbs; a reel fabricated of plastic and including an elongated center section and first and second side sections, the center section being formed in a generally cylindrical configuration with an outer wall and an essentially hollow interior, a tube being positioned through the axis of the center section, each side section being formed in a generally planar circular configuration with an inner surface, an outer surface, a centerpoint and a outer periphery, the inner surface of each side section being affixed to the center section, the outer periphery of each side section including a plurality of circular apertures formed therein, each side section including a hole positioned at its center point, the first side section including a generally trapezoidal shaped aperture and a slot, the trapezoidal shaped aperture being in communication with the hollow interior of the center section for storage of the string of lights and accessories, the trapezoidal shaped aperture being covered by an associated door including a handle attached thereto, the slot having an upper portion formed in a generally rectangular configuration and a lower portion formed in a generally trapezoidal configuration; and a dowel fabricated of wood and formed in an elongated cylindrical configuration, the dowel being positionable through the central canal of the center section, the dowel also being positionable through the holes in the side sections, in an operative orientation a user placing the male plug of the string of lights through the slot to secure it in place, the user then rotating the reel around the dowel thereby winding the string of lights around the outer wall of the center section.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved light string storage reel which has all the advantages of the prior art reels and none of the disadvantages.

It is another object of the present invention to provide a new and improved light string storage reel which may be easily and efficiently manufactured and marketed.

It is a further object of the present invention to provide a new and improved light string storage reel which is of durable and reliable construction.

An even further object of the present invention is to provide a new and improved light string storage reel which is susceptible of a low cost of manufacture with regard to both materials and labor, and which accordingly is then susceptible of low prices of sale to the consuming public, thereby making such a light string storage reel economically available to the buying public.

Still yet another object of the present invention is to provide a new and improved light string storage reel which provides in the apparatuses and methods of the prior art some of the advantages thereof, while simultaneously overcoming some of the disadvantages normally associated therewith.

Even still another object of the present invention is to provide a new and improved light string storage reel for storing strings of lights and light accessories in a neat and organized fashion.

Lastly, it is an object of the present invention to provide a new and improved light string storage reel comprising: at least one reel including a center section and first and second side sections, each center section being formed in a generally cylindrical configuration with an essentially hollow interior, each side section having a hole and being affixed to the center section, the first side section including an aperture and a slot, the aperture being in communication with the hollow interior of the center section for storage of the string of lights and accessories, in an operative orientation a user placing a plug of a string of lights through the slot to secure it in place, the user then rotating the reel thereby winding the string of lights.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side perspective of the apparatus illustrating the compartment door.

FIG. 4 is a cross sectional view of the apparatus taken along section line 4—4 of FIG. 3.

The same reference numerals refer to the same parts through the various Figures.

DESCRIPTION OF THE PREFERRED EMBODIMENT

Figure 1:
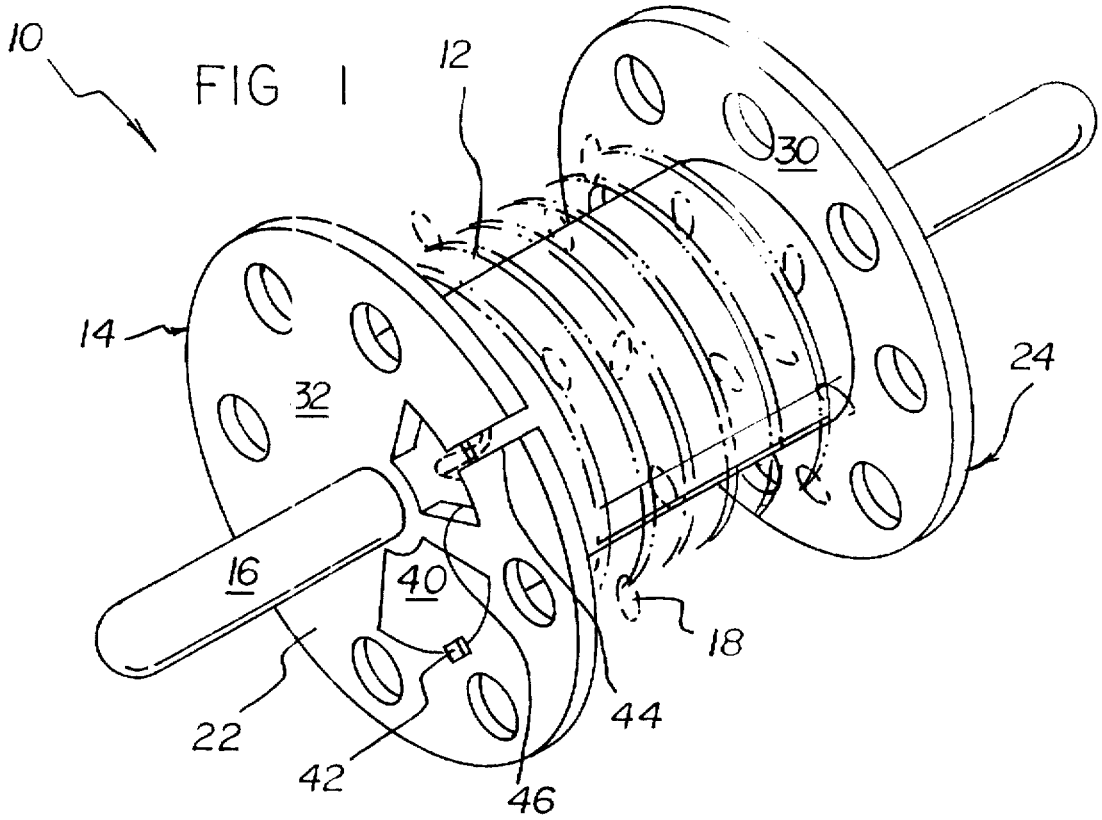
FIG. 1 is a perspective view of the preferred embodiment of the light string storage reel constructed in accordance with the principles of the present invention.

With reference now to the drawings, and in particular, to FIG. 1 thereof, the preferred embodiment of the new and improved light string storage reel embodying the principles and concepts of the present invention and generally designated by the reference number 10 will be described.

Specifically, it will be noted in the various Figures that the device relates to a light string storage reel 10. In its broadest context, the device consists of a string of lights 12, a reel 14 and a dowel 16. Such components are individually configured and correlated with respect to each other so as to attain the desired objective.

The string of lights 12 has a male outlet plug and a plurality of light bulbs 18. In the primary embodiment of the apparatus one hundred foot christmas tree lights are utilized. In alternate embodiments, light strings of twenty five feet, fifty feet or seventy five feet are utilized. In a further alternative embodiment, a string of lights is not included with the apparatus. Note FIG. 1.

Figure 2:
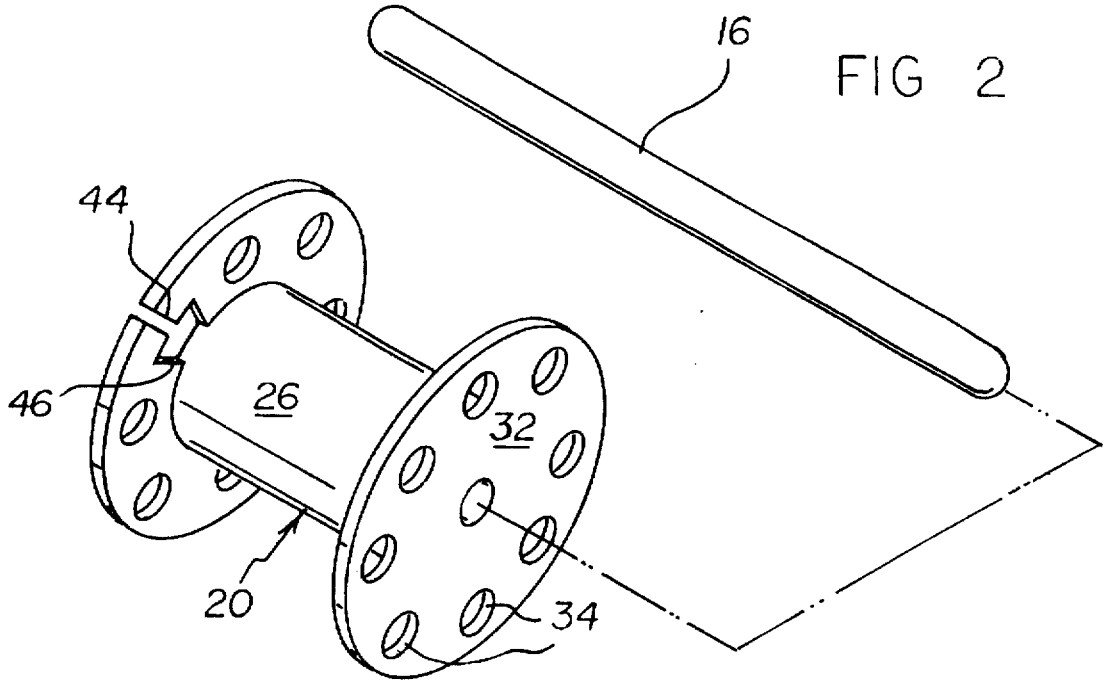
FIG. 2 perspective view of the apparatus with the dowel removed from the reel.

The reel 14 is fabricated of plastic and includes an elongated center section 20 and first 22 and second 24 side sections. The center section is formed in a generally cylindrical configuration with an outer wall 26 and an essentially hollow interior. A tube 28 is positioned through the axis of the center section. Each side section is formed in a generally planar circular configuration with an inner surface 30, an outer surface 32, a centerpoint and a outer periphery. The inner surface of each side section is affixed to the center section. The outer periphery of each side section includes a plurality of circular apertures 34. Each side section includes a hole positioned at its center point. Note FIGS. 1 and 2.

The first side section includes a generally trapezoidal shaped aperture 36 and a slot 38. The trapezoidal shaped aperture is in communication with the hollow interior of the center section for storage of strings of lights and related accessories. The trapezoidal shaped aperture is covered by an associated door 40 which includes a handle 42 attached to it. The slot has an upper portion 44 which is formed in a generally rectangular configuration and a lower portion 46 formed in a generally trapezoidal configuration. In the preferred embodiment of the apparatus the reel has a height of nine and one half inches and a length of six inches. In alternate embodiments of the apparatus the height of the reel is about seven and one half inches. Note FIGS. 1–4.

The dowel 16 is fabricated of wood and formed in an elongated cylindrical configuration. The dowel is positionable through the central canal of the center section 20. The dowel also is positionable through the holes in the side sections 22, 24. In an operative orientation a user places the male plug of the string of lights 12 through the slot 38 to secure it in place. The user then rotates the reel around the dowel thereby winding the string of lights around the outer wall 26 of the center section. Note FIGS. 1 and 2.

Figure 5:
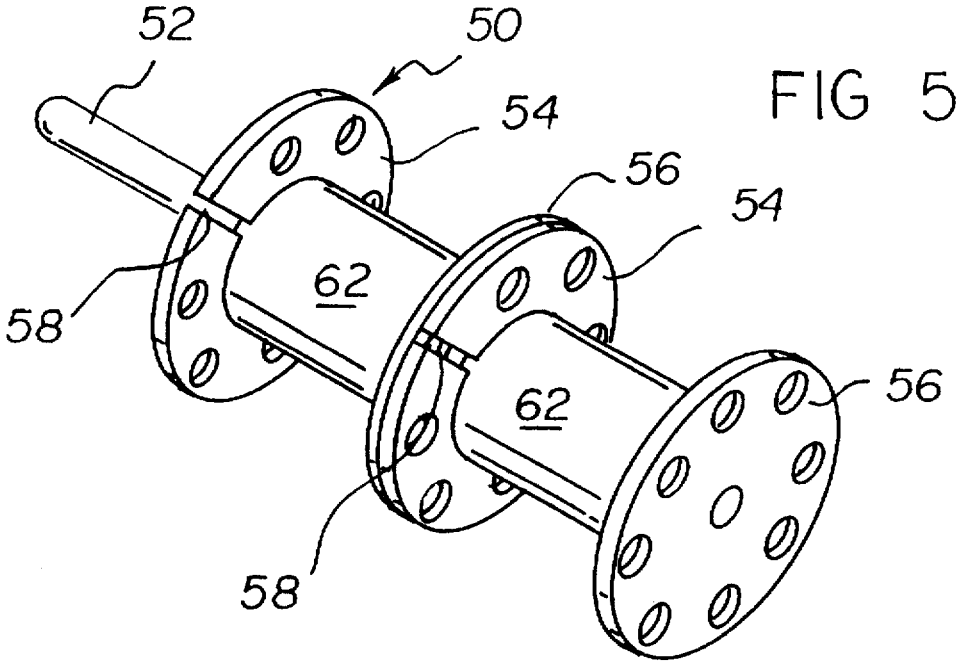
FIGS. 5 and 6 disclose an alternative embodiment of the apparatus illustrating two reels positioned in a stacked orientation.
Figure 6:
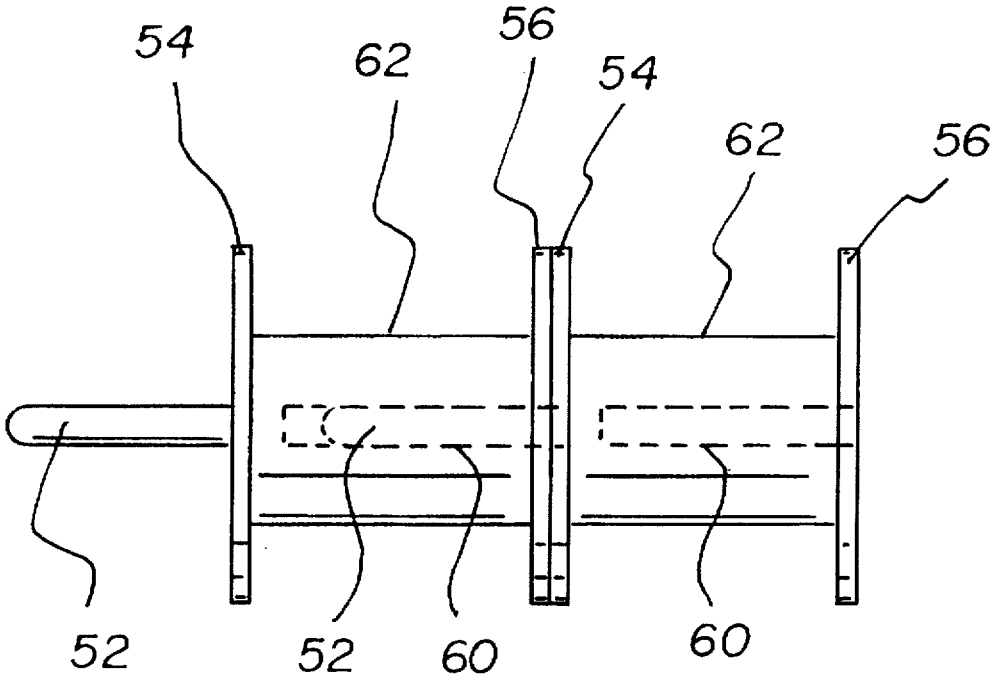

An alternate embodiment 50 of the present invention is shown in FIGS. 5 and 6. Such embodiment includes at least two reels. Each reel has substantially all of the components of the present invention except that a dowel is not included. Rather, a projection member 52 is permanently attached to the center point of each first side section 54. Note that each second side section 56 does not have a dowel or projection member extending from it. Additionally, the slot 58 in each first side section is formed in an elongated rectangular configuration. Each center section 62 includes a bore 60 with a closed end adjacent each first side section and an open end adjacent each second side section. This permits stacking of plural reel by placing the projection member of one reel within the bore of an adjacent reel. Note FIGS. 5 and 6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved light string storage reel comprising, in combination:

a string of lights having a male outlet plug and a plurality of light bulbs;

a reel fabricated of plastic and including an elongated center section and first and second side sections, the center section being formed in a generally cylindrical configuration with an outer wall and an essentially hollow interior, a tube being positioned through the axis of the center section, each side section being formed in a generally planar circular configuration with an inner surface, an outer surface, a centerpoint and a outer periphery, the inner surface of each side section being affixed to the center section, the outer periphery of each side section including a plurality of circular apertures formed therein, each side section including a hole positioned at its center point, the first side section including a generally trapezoidal shaped aperture and a slot, the trapezoidal shaped aperture being in communication with the hollow interior of the center section for storage of the string of lights and accessories, the trapezoidal shaped aperture being covered by an associated door including a handle attached thereto, the slot having an upper portion formed in a generally rectangular configuration and a lower portion formed in a generally trapezoidal configuration; and a dowel fabricated of wood and formed in an elongated cylindrical configuration, the dowel being positionable through the central canal of the center section, the dowel also being positionable through the holes in the side sections, in an operative orientation a user placing the male plug of the string of lights through the slot to secure it in place, the user then rotating the reel around the dowel thereby winding the string of lights around the outer wall of the center section.

2. A light storage reel comprising:

at least one reel including a center section and first and second side sections, each center section being formed in a generally cylindrical configuration with an essentially hollow interior, each side section having a hole and being affixed to the center section, the first side section including an aperture and a slot, the aperture being in communication with the hollow interior of the center section for storage of the string of lights and accessories, in an operative orientation a user placing a plug of a string of lights through the slot to secure it in place the user then rotating the reel thereby winding the string of lights, the slot in the first side section has an upper portion formed in a generally rectangular configuration and a lower section formed in a generally trapezoidal configuration, and wherein the center section includes a centrally positioned tube extending therethrough.

3. A light string storage reel as set forth in claim 2 and further including:

a dowel formed in an elongated cylindrical configuration, the dowel positionable through the tube of the center section.

4. A light string storage reel as set forth in claim 2 wherein at least two reels are included with the aperture, the center section of each reel including a bore having an open end adjacent its second side section and a closed end adjacent its first side section, each first side section including an elongated cylindrical projection member affixed thereto and extending therefrom, this configuration permitting stacking of one reel on top of another by placing the projection member of one reel within the bore of the adjacent reel.

* * * * *